US005344034A

United States Patent [19]

Eagan

[11] Patent Number: 5,344,034

[45] Date of Patent: Sep. 6, 1994

[54] MUSICAL ADAPTOR FOR BABY NURSING BOTTLES

[76] Inventor: Chris S. Eagan, 670 Eldorado La., Las Vegas, Nev. 89123

[21] Appl. No.: 991,387

[22] Filed: Dec. 16, 1992

[51] Int. Cl.[5] ..... A61J 9/00; G10F 1/00; G10H 7/00

[52] U.S. Cl. ..... 215/11.1; 84/600; 84/644; 84/95.2; 215/100 R; 369/63; 446/227; 446/302

[58] Field of Search ..... 84/600, 609, 644, 94.1, 84/94.2, 95.1, 95.2, 171; 215/11.1, 100 R; 369/63; 446/227, 302

[56] References Cited

U.S. PATENT DOCUMENTS 4,537,109 8/1985 Sakurai ..... 84/609

4,678,093 7/1987 Allen ..... 84/171 X 4,898,060 2/1990 To ..... 84/95.2

*Primary Examiner*—Stanley J. Witkowski

*Attorney, Agent, or Firm*—Philip D. Junkins

[57] ABSTRACT

An electronic musical adaptor for removable attachment to a baby nursing bottle to produce a musical tune to soothe and amuse the baby upon movement of the bottle during the feeding process. The adaptor comprising a cup-shaped housing, a melody producing circuit including an integrated circuit microchip within which is stored musical tune information, a battery power source, a buzzer-type speaker and a motion-activated microswitch for activating the microchip, and a wafer-like container encapsulating the melody producing circuit removably situated within the cup-shaped housing proximate the bottom thereof.

11 Claims, 1 Drawing Sheet

MUSICAL ADAPTOR FOR BABY NURSING BOTTLES

BACKGROUND OF THE INVENTION

1. Field of the Invention

The present invention relates to a musical adaptor for use with baby nursing and feeding bottles. More particularly, the invention relates to a musical adaptor unit which may be removably attached to the bottom of a baby nursing bottle whereby when the baby tips the bottle an electronic musical device inside the adaptor produces a musical tune which can soothe and amuse the baby during the feeding process.

2. Description of the Prior Art

Baby bottles have been in use in the liquid feeding of infant children for many years. Over the years, baby bottles have been provided in many shapes, forms and configurations. Infant children are frequently temperamental during the normal bottle feeding process and during attempts to have them fall asleep by providing a nursing bottle for suckling in their crib environment. Pleasant music can often divert a temperamental child's attention from the feeding process and can often help to induce the infant into sleep.

Early attempts to combine a musical unit with a baby bottle comprised spring wound musical devices affixed to the bottom of such bottles. In U.S. Pat. No. 4,678,093 S. G. Allen disclosed a musical bottom section for attachment to an open ended baby bottle with such section encapsulating: a microchip having musical information, a speaker electrically connected to the microchip, a battery electrically connected to the microchip, and mercury type microswitches electrically connected to the microchip for selectively activating the chip. The musical microchip is activated by each movement of the baby bottle through like movement of the mercury globs within the mercury microswitches. In one alternative form of the invention, Allen provides an on-off toggle switch at the exterior of the musical bottom section so that the user of the device can selectively choose whether to turn the music on or off. The Allen musical unit, for attachment to a baby bottle, is unacceptable in a baby's environment in that it incorporates switches which, although encapsulated in an insulative fill material, contain potentially harmful mercury. Further, the Allen musical unit is relatively heavy and thereby adversely affects the baby's ability to maneuver the bottle during the nursing procedure.

In U.S. Pat. No. 4,898,060 granted to P.K. To there is also disclosed a musical adapter for nursing bottles which incorporates: an electronic microchip having musical tune information, a speaker electrically connected to the microchip, a battery electrically connected to the microchip, and a microswitch (preferably of mercury type) electrically connected to the microchip to selectively activate the chip and the playing of the musical tune information. The musical adaptor of To is comprised of a two part molded plastic structure with an upper cup-like portion which fits over the lower end of a baby bottle and a lower bowl-shaped base portion which contains the electrical components of the musical adaptor and which is threaded onto a lower cylindrical joint end of the upper cup-like portion. Alternatively, the lower base portion of the adaptor may be affixed to the upper cup-like portion by channels in such base portion which twist-lock onto engaging bars of the lower cylindrical joint end of the cup-like portion. The bowl-shaped base portion requires in its bottom wall sound holes for causing sound produced within such portion to be transmitted out of the adaptor—such holes providing access of harmful dirt particles and liquids to the electrical components of the adaptor. Further, in the principal embodiments of the To adaptor, the device is subject to the activation of the electrical circuit and playing of the musical information upon any motion of the device whether it is in place associated with a baby bottle or disassociated from a bottle. In one embodiment of the To adaptor, a secondary switch is provided which activates the circuitry when the adaptor is associated with the bottom of a baby bottle but such switch does not preclude its activation, and that of the musical circuitry of the device, by other means when the adaptor is not in place on the bottom of a baby bottle.

It is an object of the present invention to provide a unique electronic musical adaptor for use with a baby nursing bottle, which adaptor is readily detachable from the bottle, and which, when the bottle is tipped from its vertical orientation for suckling by a baby, produces a musical tune to soothe and amuse the infant.

It is a further object of the invention to provide an electronic musical adaptor of light-weight construction which can be easily placed on and removed from the bottom of a baby bottle thereby to avoid being washed with the bottle.

It is another object of the invention to provide a musical adaptor of cup-shaped configuration which can be easily placed on and removed from the bottom of a baby bottle and which includes an exchangeable, relatively thin, wafer-like sealed container for housing electronic melody producing means whereby when the bottle is tipped from its vertical orientation, for suckling by a baby, there is produced one or more musical tunes.

Other objects and advantages of the invention will be apparent from the following summary and descriptions of the invention, taken together with the accompanying drawing figures.

SUMMARY OF THE INVENTION

The present invention relates to a novel musical adaptor for removable attachment to baby nursing and feeding bottles. The adaptor is of molded plastic cup-shaped configuration with upper annular bottle-gripping segments and a lower cylindrical base portion for removably holding interchangeable sealed wafer-like containers housing electronic melody producing means. The melody producing means of the invention within each sealed wafer-like container is comprised of an integrated circuit (IC) microchip (storing musical tune information) which is electrically interconnected to: a battery power source, a buzzer-type speaker, and a motion-activated microswitch which is only operable when the wafer-like container is inserted into the base portion of the adaptor. Thus, the operability of the interconnecting circuitry of the melody producing means is dependent upon closure of the circuitry by a separate microswitch which is activated upon insertion of the container into the base portion of the adaptor or by the interconnection of a pair of separated electrical contacts of the circuitry on the outer periphery of the container which are interconnected by bus bar means associated with such base portion upon insertion of the container into the adaptor.

In accordance with the present invention a series of electronic melody producing means, each holding different musical tune information (one tune or a combination of two or more tunes), may be provided in separate sealed wafer-like containers. Each of such containers, interchangeably insertable into the base portion of the musical adaptor, bears outer written tune identification information so that the user can select the tune or tunes that are desired to be played as the baby manipulates (tips) the associated bottle during a nursing or feeding procedure. Tipping or tilting movement of the baby bottle, with the musical adaptor of the invention in place at the bottom thereof, causes the motion-activated microswitch of the melody producing means (within the sealed wafer-like container) to initiate the production of the musical tune information of the IC microchip via the buzzer-type speaker.

The wafer-like containers holding the components of the melody producing means of the invention are formed of light-weight plastic material sections which are sealed together about their peripheries. The containers form a resonance sound chamber for the musical tunes produced via the IC microchip and speaker therein and therefore no sound holes are required for transmitting the musical sounds out of the containers thereby maintaining a closed dirt and liquid free environment for the enclosed components of the melody producing means. The power source for the melody producing means comprises one or two watch-type disc batteries which have a life of one or more years.

BRIEF DESCRIPTION OF THE DRAWING FIGURES

Figure 10:
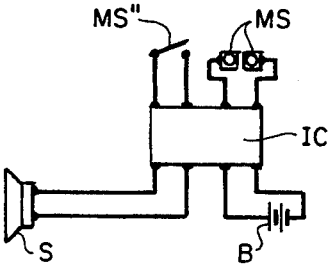
Figure 8:
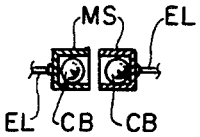
Figure 9:
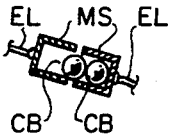

FIGS. 8 and 9 are "off" and "on" positional views, respectively, of a second form of motion-activated microswitch utilized within the alternative forms of the melody producing means of the invention; and FIG. 10 is a schematic drawing of the circuitry of one form of the melody producing means of the invention including a motion-activated microswitch and an interconnected microswitch for external activation of such circuitry.

DETAILED DESCRIPTION OF PREFERRED EMBODIMENTS OF THE INVENTION

Figure 1:
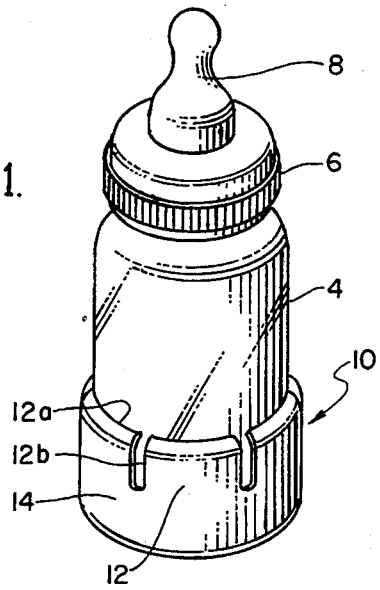
FIG. 1 is a front perspective view of a typical baby nursing or feeding bottle with the musical adaptor of the invention in place at the bottom thereof.

The present invention relates to novel musical adaptors for removable attachment to baby nursing and feeding bottles. Referring initially to FIG. 1 of the drawing sheet, there is illustrated in a perspective view a typical baby nursing or feeding bottle 4 with a screw-on cap 6 and nipple 8. Removably attached to the lower end of the bottle 4 is a musical adaptor housing 10 of generally cup-shaped configuration. The adaptor housing 10 is more particularly shown in FIG, 2 which is a front exploded perspective view of the musical adaptor of the invention including a first alternative form of the wafer-like container and enclosed electronic melody producing means of the adaptor. The wafer-like container is normally seated within the adaptor housing in the bottom portion thereof.

The adaptor housing 10 is preferably composed of suitable molded plastic material and includes an annular series of upper bottle-gripping segments 12 (including inwardly projecting gripping lips **12*a*) which are separated by slots 12*b* so that the segments may be flexed outwardly during placement of the housing on the lower end of a nursing bottle and provide gripping action for the housing with respect to the bottle. The lower cylindrical base portion 14 of the adaptor housing 10 includes a bottom wall or floor 14*a* with a central finger hole 14*b*** for dislodging the wafer-like container which encloses the melody producing means.

Figure 2:
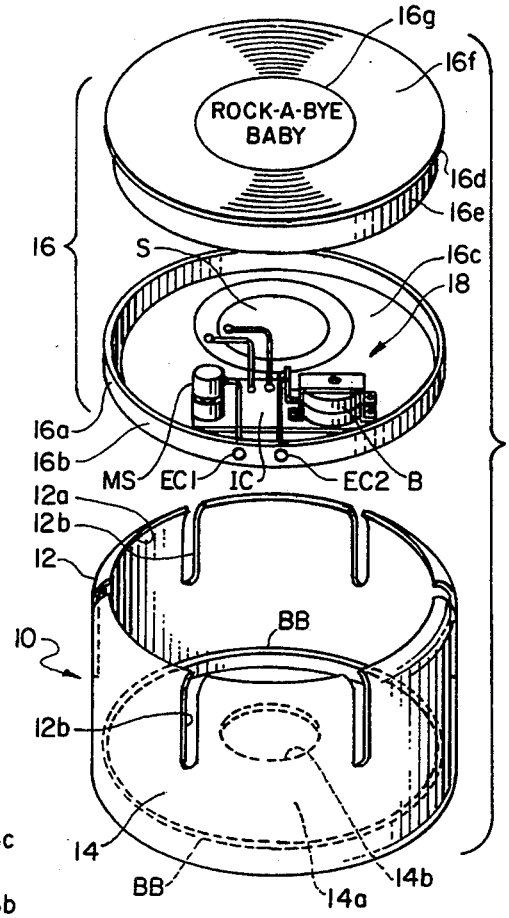
FIG. 2 is a front exploded perspective view of the musical adaptor for baby bottles, of the invention, showing the structure and internal components of a first alternative form of the wafer-like container and enclosed electronic melody producing means of the adaptor.

As shown in FIG. 2, the wafer-like container 16 is comprised of a base section and a top section for closing the container and its internal melody producing means. The base section **16*a* of the container 16 includes an shallow annular side wall 16*b* and a bottom wall or floor 16*c*. The top section 16*d* of the container 16 includes an annular side wall 16*e* and a top wall 16*f*. There may be located on the top wall 16*f* a melody identification label 16*g***.

Carried within the base section **16*a* of the wafer-like container 16 are the components of the electronic melody producing means 18. In accordance with the invention, the melody producing means 18 is comprised of an integrated circuit microchip IC (stores musical tune information) which is electrically interconnected to: a battery power source B, a buzzer-type speaker S, and a motion-activated microswitch MS. The microswitch MS, as shown in FIG. 2, is described in detail hereinafter in connection with its operation as shown in FIGS. 8 and 9. One of the electrical leads of the microswitch MS is connected to an electrical contact EC1 located on the outer periphery of the side wall 16*b* of the base section 16*a* of container 16. A second electrical contact EC2, also located on the side wall 16*b* of the base section 16*a***, is connected by an electrical lead to the microchip IC.

Located within the base portion 14 of the adaptor housing 10, about the periphery thereof above the floor **14*a*, is an annular electrical conductor or bus bar BB. Thus, when the wafer-like container 16 is inserted into the housing, the outer electrical contacts EC1 and EC2 of the container are interconnected by bus bar BB (regardless of the position of the container within the adaptor housing). Thereby, the circuitry of the melody producing means 18 (within the container 16) is closed except for the closing action of microswitch MS caused by tilting motion of the baby bottle 4 and the musical adaptor. Through this construction of adaptor housing 10 and the interacting structure of the insertable wafer-like container 16, the melody producing means 18** within the container is precluded from having its circuitry closed to render a melody when the container is outside of the adaptor housing.

Following the placement and electrical interconnection of the components of the melody producing means within the container base section 16*a*, the top section 16*d* of the container is sealed to the base section yielding a closed environment for such components. A series of the wafer-like containers 16 may be provided with each container including in its melody producing means a microchip IC having stored therein a different melody or series of melodies. Thereby, by interchangeable placement of such containers in the adaptor housing 10 (and affixation of the housing to a baby bottle), a selection of melodies may be presented to the baby holding and moving the bottle during its feeding time. In accordance with the embodiment of the invention shown in FIG. 2, the circuitry of the melody producing means 18 of the closed (sealed) wafer-like container 16 is only capable of being closed by the motion-activated microswitch NS when the container is seated within housing 10 with the electrical contacts EC1 and EC2 conductively joined through their respective engagement with the bus bar BB of the housing. Thus, a series of different melody producing means 18 may be provided in their respective containers 16 and stored without use of their battery sources over a long period of time.

Figure 3:
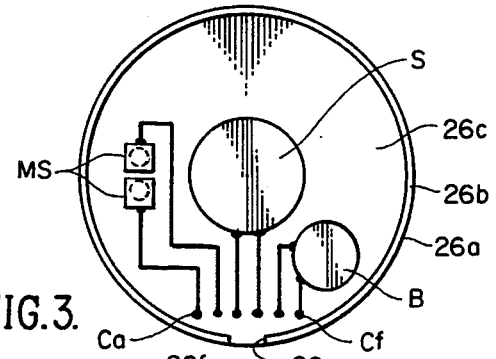
FIG. 3 is a top plan view of the bottom section of a second alternative form of the wafer-like container and speaker, battery and motion-activated microswitch components of the melody producing means of the invention.
Figure 4:
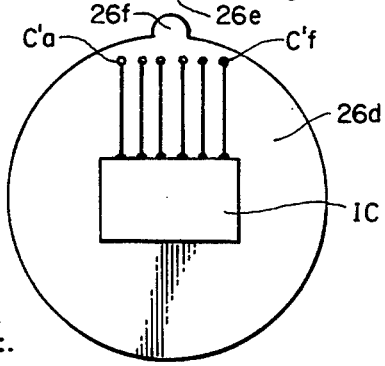
FIG. 4 is a plan view of the underside of an interchangeable top section for the wafer-like container of FIG. 2 showing an interchangeable IC microchip mounted thereon.

A second alternative embodiment of the present invention is illustrated in FIGS. 3 and 4. In such embodiment, the bottom section 26*a* of a wafer-like container for a melody producing means (shown in FIG. 3) includes a shallow annular side wall 26*b* and a bottom wall or floor 26*c*. The battery component B, speaker component S and motion-activated microswitch component MS of the melody producing means are mounted to the bottom wall 26*c* of the bottom section of the container. Each of such components are appropriately interconnected by leads to a series of electrical contacts Ca–Cf.

The underside of a disc-like top or closure section 26*d* for the wafer-like container is shown in FIG. 4 and has mounted thereon a microchip IC with its internally stored musical tune information. The microchip has leads interconnected to electrical contacts C'a–C'f which are appropriately placed so as to interface electrically with the contacts Ca–Cf of the bottom section 26*a* of the container when the top section 26*d* is inverted and placed in closure position on the bottom section. To assure appropriate alignment of the contacts C'a–C'f of closure section 26*d* with the contacts Ca–Cf of the bottom section 26*a*, the annular side wall 26*b* of the bottom section may be provided with means (such as a notch 26*e*) into which mating means (such as a tab 26*f*) of the top section is seated. Snap fitment of the top section 26*d* into the bottom section 26*a* by any appropriate means may be provided. Thus, interchangeability of top sections, with different musical tune information microchips, provides means for selection of the melodies that may be provided via the musical adaptor of the invention.

Figure 5:
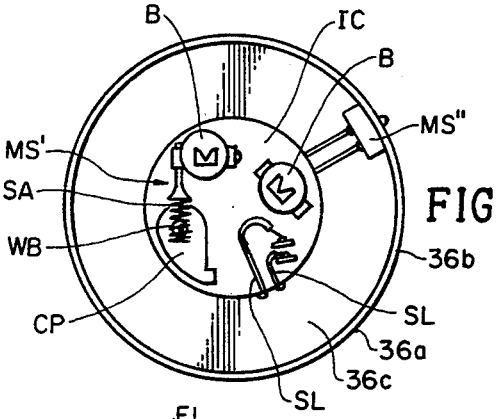
FIG. 5 is a top plan view of the bottom section of a third alternative form of the wafer-like container and melody producing means of the invention with an interconnected microswitch for external activation of the circuitry of the melody producing means.

Referring now to FIG. 5, there is illustrated a third alternative embodiment of a melody producing means in accordance with the invention. Again, a bottom section 36*a* to a wafer-like container for the melody producing means includes an annular side wall 36*b* and a bottom wall 36*c*. The components of the melody producing means include microchip IC (contains stored musical tune information), batteries B, motion-activated microswitch MS' and a buzzer-type speaker (not shown). These components are connected to the microchip by appropriate leads. The speaker is mounted under the microchip and is connected to the microchip via leads SL. Also provided in the circuitry of the melody producing means is a second microswitch MS" which includes external touch button means which when actuated closes the circuitry (except for the motion-activated microswitch). Actuation of the microswitch MS" is accomplished when the closed wafer-like container (enclosing the melody producing means) is inserted into a housing such as the adaptor housing 10 shown in FIGS. 1 and 2. The microswitch MS' is comprised of a spring arm SA, a weight ball WB and a contact plate CP.

Figure 6:
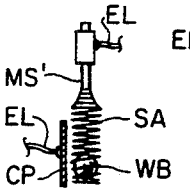
FIGS. 6 and 7 are "off" and "on" positional views, respectively, of one form of motion-activated microswitch utilized within the alternative forms of the melody producing means of the invention.
Figure 7:
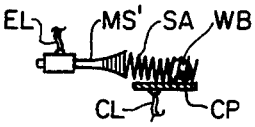

Operation of the motion-activated microswitch MS' of the melody producing means of FIG. 5 is illustrated via the "off" and "on" positional views of the switch in FIGS. 6 and 7. In FIG. 6 the switch is shown in one of the many possible "off" positions determined by manipulation of the baby bottle with the musical adaptor containing the melody producing means. In such position the spring arm SA (in electrical circuit communication with a microchip [not shown] via a lead EL) is oriented out of contact with contact plate CP (also in electrical circuit communication with the microchip [not shown] through a lead EL). The spring arm encloses the weight ball WB which is free to shift within the spring portion of such arm. In FIG. 7 the microswitch MS' is shown in an "on" position (achieved periodically during manipulation of the baby bottle) with the spring arm SA (formed of conductive spring wire) flexed by the weight ball WB into electrical contact with the contact plate CP. In such an "on" position the microswitch Ms' closes the circuitry of the melody producing means, provided, the wafer-like container enclosing such means is in place within a cup-shaped adaptor on a baby bottle with the microswitch MS" closed.

Operation of the motion-activated microswitch MS of the melody producing means of FIGS. 2 and 3 is illustrated via the "off" and "on" positional views of the switch in FIGS. 8 and 9. In FIG. 8 the switch, comprised of like but not contacting conductive cylinders (in electrical circuit communication with a microchip [not shown] via leads EL), is shown an "off" position with metal contact balls CB out of contact with one another. In FIG. 9 the microswitch MS is shown in an "on" position (achieved periodically during manipulation of the baby bottle) with the contact balls in electrical contact with one another to bridge the gap between the conductive cylinders to complete the circuit for initiation of the stored melody producing information of the microchip IC (not shown in FIGS. 8 and 9). As in the case of the microswitch MS' of FIGS. 5, 6 and 7, secondary microswitch means may be provide in the circuitry of the melody producing means so that the microchip melody program can not be initiated until such secondary switch is closed.

In FIG. 10 there is shown a schematic drawing of the circuitry of one form of the melody producing means of the invention. The components of the circuitry are: an eight terminal musical tune microchip IC; a motion-activated microswitch MS of the type shown in FIGS.

2, 3, 8 and 9; a battery B; a buzzer-type speaker S; and a secondary microswitch MS" for external activation of the circuitry of the melody producing means, all of the components of such melody producing means being appropriately interconnected to terminals of the microchip IC.

It is to be understood that once initiated the stored musical tune program of the microchips (utilized in the melody producing means of the invention) continues uninterrupted until completed. Thus, once the program is initiated further movement of the baby bottle and its musical adaptor (including the melody producing means and its motion-activated microswitch) will not terminate the program (even if the motion-activated switches as described hereinbefore are in an "off" position) and the replaying of the program (caused by the motion-activated switches being moved to an "on" position) will not occur until the full program is played out. Where a secondary microswitch is incorporated into the circuitry of the melody producing means, deactivation of such switch (as by removal of the wafer-like container of FIG. 2 from the musical adaptor housing) will terminate the playing of the musical tune program of the microchip. It should also be understood that the melody producing means of the invention can be energized by one or more watch-type batteries of mercury cell design each of which should produce an energizing life to the circuitry of at least a year of intermittent use during movement of such device with a feeding or nursing baby bottle. The buzzer-type speaker may preferably be formed of a piezoelectric semiconductor element.

While preferred embodiments of the present invention have been disclosed herein and illustrated in the accompanying drawing figures, it will be apparent to one skilled in the art that many variations and modifications may be made without departing from the scope and spirit of the invention as defined by the following claims.

What I claim is:

1. An electronic musical adaptor for removable attachment to a baby nursing bottle to produce a musical tune to soothe and amuse the baby upon movement of the bottle during the feeding process, said adaptor comprising:

a) a cup-shaped housing having a cylindrical side wall and a bottom wall, the upper portion of said side wall including bottle-gripping means for releasably holding said housing onto the lower portion of a baby nursing bottle;

b) melody producing circuit means including an integrated circuit microchip within which is stored musical tune information, a battery power source electrically interconnected to said microchip, a buzzer-type speaker electrically interconnected to said microchip, and a motion-activated microswitch electrically interconnected to said microchip for activating said microchip; and c) a wafer-like container encapsulating the melody producing circuit means and removably situated within the cup-shaped housing proximate the bottom wall thereof, said melody producing circuit means including means external of said container for interacting with said housing to activate said circuit means only when said container is seated within said housing.

2. An electronic musical adaptor for removable attachment to a baby nursing bottle as claimed in claim 1 wherein the means external of said container for interacting with said housing to activate said melody producing circuit means includes open circuit leads of said circuit means which are interconnected by interconnect means of said housing to close said circuit means only when said container is seated within said housing.

3. An electronic musical adaptor for removable attachment to a baby nursing bottle as claimed in claim 1 wherein the means external of said container for interacting with said housing to activate said melody producing circuit means is a pressure sensitive microswitch electrically interconnected to said circuit means, located in the periphery of said container and presenting touch button means depressible by the housing of said adaptor when said container is seated within said housing.

4. An electronic musical adaptor for removable attachment to a baby nursing bottle as claimed in claim 2 wherein the interconnect means of said housing external of said container to activate said melody producing circuit means is an electrical bus bar encircling the inner periphery of said housing and positioned to interconnect said open circuit leads when said container is seated within said housing.

5. An electronic musical adaptor for removable attachment to a baby nursing bottle as claimed in claim 1 wherein the motion-activated microswitch of the melody producing circuit means is comprised of a flexible spring arm and a contact plate each electrically interconnected to said microchip, said spring arm surrounding a weight ball which is shiftable therein to bend said arm into electrical contact with said contact plate upon motion of said adaptor to activate said microchip.

6. An electronic musical adaptor for removable attachment to a baby nursing bottle as claimed in claim 1 wherein the motion-activated microswitch of the melody producing circuit means is comprised of a pair of conductive cylinders spaced from one another and each electrically interconnected to said microchip, said cylinders containing a pair of metallic contact balls shiftable therein to contact one another and bridge the space between said cylinders to complete the circuit for initiation of the stored musical tune information of said microchip.

7. An electronic musical adaptor for removable attachment to a baby nursing bottle as claimed in claim 1 wherein the bottle-gripping means of the upper portion of the side wall of the cup-shaped housing of said adaptor comprises an annular series of housing segments which are separated by slots so that said segments may be flexed outwardly during placement of said housing on the lower end of the baby nursing bottle.

8. An electronic musical adaptor for removable attachment to a baby nursing bottle as claimed in claim 7 wherein the annular series of housing segments of the upper portion of the cup-shaped housing each include inwardly projecting bottle-gripping lips.

9. An electronic musical adaptor for removable attachment to a baby nursing bottle as claimed in claim 1 wherein the wafer-like container encapsulating the melody producing circuit means of said adaptor comprises a base section within which the components of said circuit means are mounted and a cover section for closing said container.

10. An electronic musical adaptor for removable attachment to a baby nursing bottle as claimed in claim 9 wherein the cover section of said wafer-like container is sealed to the base section of said container.

11. An electronic musical adaptor for removable attachment to a baby nursing bottle as claimed in claim 1 wherein the wafer-like container encapsulating the melody producing circuit means of said adaptor comprises a base section within which said battery power source, said buzzer-type speaker, and said motion-activated microswitch are mounted and a removable cover section bearing said integrated circuit microchip, said base section and said cover section each bearing interfacing electrical contacts with circuit leads for interconnecting said power source, said speaker and said microswitch to said microchip.

* * * * *